United States Patent [19]

Nakanishi et al.

[11] 4,212,270

[45] Jul. 15, 1980

[54] COOLING SYSTEM FOR AN INTERNAL COMBUSTION ENGINE

[75] Inventors: Kiyoshi Nakanishi; Takeshi Okumura, both of Susono, Japan

[73] Assignee: Toyota Jidosha Kogyo Kabushiki Kaisha, Toyota, Japan

[21] Appl. No.: 835,722

[22] Filed: Sep. 22, 1977

[30] Foreign Application Priority Data

May 24, 1977 [JP] Japan ..... 52-60063

[51] Int. Cl.[2] ..... F01P 7/16

[52] U.S. Cl. ..... 123/41.09; 123/41.1; 123/41.29; 123/41.44; 123/41.46

[58] Field of Search ..... 123/41.02, 41.05, 41.09, 123/41.1, 41.29, 41.46, 41.47, 41.28, 41.44

[56] References Cited

U.S. PATENT DOCUMENTS

| | | | |
|---|---|---|---|
| 1,500,668 | 7/1924 | Church | 123/41.29 |
| 1,774,881 | 9/1930 | Fry | 123/41.29 |
| 1,962,134 | 6/1934 | Brubaker | 123/41.09 |
| 1,985,240 | 12/1934 | Brubaker | 123/41.29 |
| 2,059,916 | 11/1936 | Smith | 123/41.29 |
| 2,069,749 | 2/1937 | Brubaker | 123/41.29 |
| 2,677,357 | 5/1954 | Brubaker | 123/41.1 |
| 3,444,845 | 5/1969 | Scheiterlein | 123/41.29 |
| 3,892,209 | 7/1975 | Amiot | 123/41.29 |

*Primary Examiner*—Charles J. Myhre
*Assistant Examiner*—Jeffrey L. Yates
*Attorney, Agent, or Firm*—Stevens, Davis, Miller & Mosher

[57] ABSTRACT

A cooling system for an internal combustion engine, having a first circuit means for circulating cooling water through a cylinder block and a second circuit means for circulating cooling water through a cylinder head and temperature control means for controlling the temperature of the cooling water circulating through the first and the second circuit means substantially independently from each other so that the temperature of the cooling water circulating through the first circuit means is higher than that of the cooling water circulating through the second circuit means.

2 Claims, 4 Drawing Figures

COOLING SYSTEM FOR AN INTERNAL COMBUSTION ENGINE

BACKGROUND OF THE INVENTION

The present invention relates to a cooling system for an internal combustion engine.

An internal combustion engine generally incorporates a cooling system which comprises water jackets formed in the engine housing including a cylinder block and a cylinder head, a radiator, a water pump, and conduit means which connect the water jackets, radiator, and water pump in a manner of establishing a cooling water flow circuit. In a conventional cooling system of this type, the cooling water delivered from the water pump is first introduced into a water jacket formed in the cylinder block through an inlet port of the water jacket provided at a front portion thereof and, after having flowed through the water jacket of the cylinder block, the cooling water is then introduced into a water jacket formed in the cylinder head through a connecting passage formed in a joining portion of the cylinder block and the cylinder head so that the cooling water then flows through the water jacket of the cylinder head. After having flowed through the water jacket of the cylinder head, the cooling water then flows out of the water jacket of the cylinder head through an outlet port formed at a front portion of the cylinder head and is led towards the radiator through a conduit. After having flowed through the radiator while radiating heat therefrom, the cooling water is returned to the intake port of the water pump through a conduit.

The temperature of the cooling water circulated through the cooling system for an internal combustion engine is controlled to be in a certain range so as not to cause any undesirable overheating of the engine on the one hand while not, on the other hand, causing an overcooling of the engine, which would deteriorate the combustibility of fuel in the cylinders. In accordance with these requirements, the temperature of cooling water is generally controlled to be within the range 80°–90° C.

In gasoline engines, if the target cooling water temperature is set at a relatively low value, octane number requirement, i.e., the minimum octane number of gasoline required for avoiding knocking in the engine, lowers, thereby enabling engine performance and/or economy of operation to be improved, while on the other hand when the target cooling water temperature is lowered, the disadvantage occurs that the emission of HC in exhaust gases increases.

Knocking in gasoline engines is caused by self-ignition of fuel-air mixture and is more apt to occur when fuel-air mixture is subjected to a higher temperature and higher pressure condition. Since a high temperature and high pressure condition such as to cause self-ignition of the fuel-air mixture occurs when the fuel-air mixture is compressed in the combustion chamber of an engine by the piston being shifted approximately to the top dead center, the possibility of knocking is not related to the temperature of the side wall of the cylinder but is substantially related to the temperature of the top wall of the combustion chamber which is provided by the cylinder head. In other words, the octane number requirement increases as the temperature of the top wall of the combustion chamber increases.

In view of the abovementioned two facts with regard to engine performance, it is desirable that the temperature of the cooling water for effecting the cooling of the top wall of the combustion chamber should be set at a relatively low value while the temperature of the cooling water for effecting the cooling of the side wall of the cylinder is set at a relatively high value, whereby it is to be expected that the octane number requirement is lowered while the emission of HC in exhaust gases is also lowered.

However, in a conventional cooling system having a single cooling water flow circuit which incorporates the water jackets formed in the cylinder block and the cylinder head in series, the cooling water is first passed through the water jacket of the cylinder block and is then passed through the jacket formed in the cylinder head so that the natural head difference caused in the circuit due to gradual heating up of cooling water is effectively utilized for helping to drive the cooling water through the circuit. In this case, therefore, the temperature of the cooling water flowing through the water jacket of the cylinder head is higher than that of the cooling water flowing through the water jacket of the cylinder block, contrary to the aforementioned requirement.

SUMMARY OF THE INVENTION

It is therefore the object of the present invention to provide a novel cooling system for an internal combustion engine having a cylinder block and a cylinder head by which the cylinder head is cooled to a relatively low temperature while the cylinder block is cooled to a relatively high temperature.

In accordance with the present invention, the abovementioned object is accomplished by a cooling system for an internal combustion engine having a cylinder block and a cylinder head, comprising a first circuit means for circulating cooling water through said cylinder block, a second circuit means for circulating cooling water through said cylinder head, and temperature control means for controlling temperature of the cooling water circulating through said first and second circuit means independently from each other.

By employing a cooling system such as mentioned above, the wall temperature of the combustion chamber and that of the cylinder can be individually controlled at the most desirable temperatures independently from each other for favorably reducing the octane number requirement of the engine while simultaneously reducing the emission of HC in the exhaust gases.

In the cooling system of the present invention, said first and second circuit means may incorporate a single common radiator in combination with a particular circuit system wherein a portion of the cooling water circulated through said second circuit means is circulated through the radiator while the remaining portion of the cooling water circulated through said first circuit means is recirculated without being passed through the radiator. In a modification of the cooling system of the present invention, said first and second circuit means may incorporate individual radiators so as to establish individual cooling systems substantially independently from each other.

BRIEF DESCRIPTION OF THE DRAWING

The present invention will become more fully understood from the detailed description given herein below and the accompanying drawings which are given by way of illustration only and thus are not limitative of the present invention, and wherein.

DESCRIPTION OF THE PREFERRED EMBODIMENT

Figure 1:
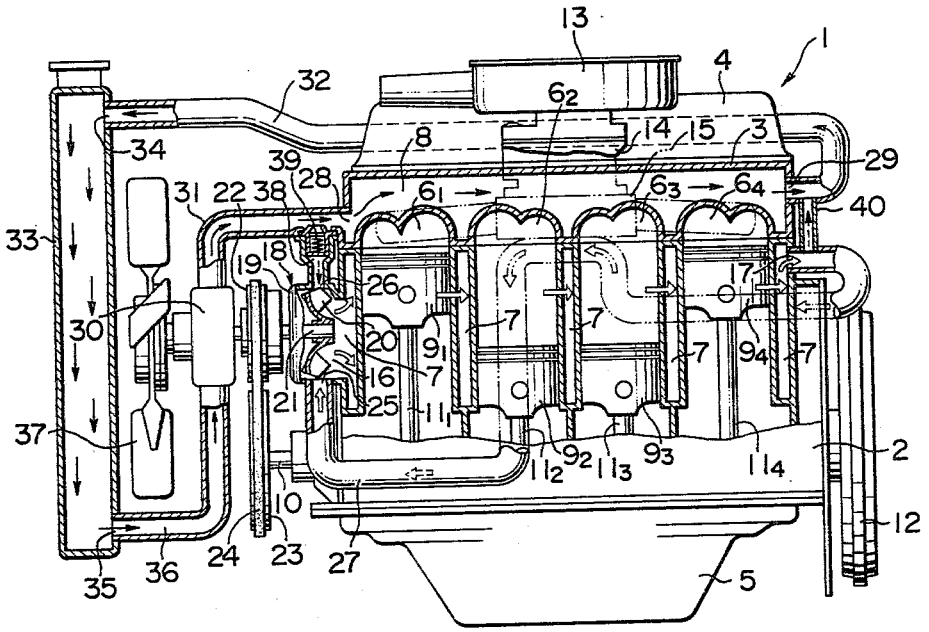
FIG. 1 is a partially sectional view of a multi-cylinder internal combustion engine incorporating an embodiment of the cooling system of the present invention.

Referring to FIG. 1, 1 generally designates an engine housing including a cylinder block 2, a cylinder head 3 mounted on the cylinder block, a cylinder head cover 4 further mounted on the cylinder head and an oil pan 5 mounted below the cylinder block.

The cylinder block 2 defines the side walls of the combustion chambers $6_1$–$6_4$ or the walls of cylinder bores and a first continuous cooling water jacket around the side walls of the combustion chambers. The cylinder head 3 defines the top walls of the combustion chambers $6_1$–$6_4$ and a second continuous cooling water jacket 8 over the top walls. As opposed to the conventional engine structure, the cylinder block and the cylinder head are not provided with any connecting passages to communicate said first and second cooling water jackets 7 and 8 with one another at their joining faces.

In the cylinder bores $6_1$–$6_4$ defined by the cylinder block 2 are slidably mounted pistons $9_1$–$9_4$ which are connected with a crankshaft 10 by connecting rods $11_1$–$11_4$ respectively. A flywheel 12 is mounted to the rear end portion of the crankshaft. The combustion chambers defined by the cylinder bores and the pistons slidably mounted therein are adapted to be supplied with fuel-air mixture through an intake manifold 15, said fuel-air mixture being produced in a carburetor 14 by employing air taken in through an air cleaner 13. The combustion gases generated in the combustion chambers as a result of combustion of the fuel-air mixture are exhausted through an exhaust manifold, the illustration of which is omitted in FIG. 1 for the purpose of simplicity. Furthermore, although intake and exhaust ports are not shown in FIG. 1, they are provided in the cylinder head 3 and are adapted to be opened or closed by poppet valves adapted to be driven by a conventional valve driving mechanism (not shown) incorporated in the cylinder head 3 and the cylinder head cover 4. Although not shown either, ignition plugs are provided, mounted in the top wall portions of the combustion chambers.

The cylinder block 2 has an inlet port 16 in its front wall portion for introducing cooling water to said first cooling water jacket 7 while it has an outlet port 17 at its rear wall portion for discharging cooling water therefrom. A water pump 18 is mounted in the front wall portion of the cylinder block 2. The water pump comprises a pump housing 19 having a delivery port communicating to the aforementioned inlet port 16 and two intake ports 25 and 26 and a pump impeller 20 mounted in the pump housing and supported by a pump shaft 21 which extends from the pump housing 19 and supports a pulley 22. The crankshaft 10 also supports a pulley 23 at the front end portion thereof. A V-belt 24 is engaged around the pulleys 22 and 23 so that the pump 18 is driven by the crankshaft 10. The inlet port 25 of the water pump 18 is connected with a first cooling water return pipe 27, the other end of which is connected with the cooling water outlet port 17 of the cylinder block. A middle portion of the cooling water return pipe 27 is joined with a riser portion of the intake manifold 15 so that the riser portion is warmed by the cooling water flowing through the return pipe.

The cylinder head 3 has an inlet port 28 and an outlet port 29 in a front wall portion and a rear wall portion thereof, respectively, said inlet port introducing cooling water into said second cooling water jacket 8 while said outlet port discharges cooling water from the jacket 8. The cooling water inlet port 28 is connected with a delivery port of a second water pump 30 by a conduit 31, said water pump 30 being driven by the same pump shaft as the water pump 18 for the first cooling water circuit means incorporated in the cylinder block. The cooling water outlet port 29 is connected with one end of a second cooling water return pipe 32, the other end of which is connected with an inlet port 34 provided at an upper end portion of a radiator 33 positioned in front of the engine housing 1. The radiator 33 has a cooling water discharge port 35 at a bottom portion thereof, said cooling water discharge port being connected with an inlet port of the water pump 30 by means of a conduit 36. The pump shaft 21 extends further forward beyond the water pump 30 and there it supports a cooling fan 37.

A connecting pipe 38 is branched from a middle portion of the conduit 31 and is connected with the other inlet port 26 of the water pump 18. A thermostat valve 39 is incorporated in the connecting pipe 38. The thermostat valve 39 opens so as to establish communication between the conduit 31 and the connecting pipe 38 when the temperature of the cooling water flowing through the first cooling water jacket 7 is higher than a predetermined value, while on the other hand it closes so as to interrupt the communication of the conduit 21 and the connecting pipe 38 when the temperature of the cooling water flowing through the first cooling water jacket 7 is lower than a predetermined value. The first cooling water return pipe 27 and the second cooling water return pipe 32 are connected with each other by a connecting pipe 40.

The cooling system shown in FIG. 1 operates as follows:

When the internal combustion engine shown in FIG. 1 operates, the water pumps 18 and 30 and their cooling fan 37 are rotationally driven by the crankshaft 10. When the temperature of the cooling water flowing through the first cooling water jacket 7 is lower than a predetermined value, the thermostat valve 39 is closed. In this condition, two independent water flow circuits are established, i.e., a first circuit incorporating water pump 18 - cooling water jacket 7 - cooling water return pipe 27, and a second circuit incorporating water pump 30 - conduit 31 - cooling water jacket 8 - cooling water return pipe 32 - radiator 33 - conduit 36. In the second circuit, cooling water delivered from the water pump 30 takes up heat while it flows through the cooling water jacket 8 provided in the cylinder head 3 thereby cooling principally the top wall portions of the combustion chambers, and, thereafter, the cooling water is conducted through the cooling water return pipe 32 to the radiator 33. In the radiator the cooling water radiates heat and is cooled down and then it is returned to the water pump 30 to be recirculated through the cooling water jacket 8. On the other hand, in the first circuit, cooling water delivered from the water pump 18 flows through the cooling water jacket 7 while cooling the side wall portions of the cylinder bores and then is directly returned to the water pump 18 through the cooling water return pipe 27, although a little cooling effect is applied to the cooling water when it flows in a heat-exchanging relationship with the riser portion of the intake manifold 14 where the cooling water gives a little amount of heat to the riser portion which is then heated. Therefore the cooling water flowing through the second circuit including the cooling water jacket 8 is maintained at a relatively low temperature, whereas the cooling water flowing through the first circuit including the cooling water jacket 7 is not cooled at all by means of the radiator and is heated up to a relatively high temperature. In a desirable embodiment, the performance of said second circuit including the cooling water jacket 8 is determined so as to maintain the cooling water temperature below 60° C. by properly designing the amount of cooling water, heat radiation by the radiator and other variables, while on the other hand the cooling water temperature of said first circuit including the cooling water jacket 7 is maintained at a predetermined relatively high value such as above 80° C. by properly adjusting the performance of the thermostat valve 39. When the connecting pipe 38 is intercepted, no substantial flow of water occurs through the connecting pipe 40.

When the temperature of the cooling water flowing through the first cooling water jacket 7 reaches the predetermined temperature, the thermostat valve 39 opens so as to allow a part of the cooling water which has passed through the radiator and has a relatively low temperature to flow through the connecting pipe 38 toward the inlet port 26 of the water pump 18. In this condition, the water pump 18 delivers a mixture of water supplied from the radiator and water returned through the cooling water return pipe 27, said mixture having as a matter of course a temperature intermediate between the temperature of the cooling water flowing through the conduit 31 and that of the hotter cooling water returned through the cooling water return pipe 27. In this operation, the same amount of water as that introduced into the first circuit through the thermostat valve 39 naturally flows through the connecting pipe 40 from the first circuit to the second circuit. When the temperature of the cooling water flowing through the first cooling water jacket 7 again lowers below the predetermined temperature, the thermostat valve 39 closes so as to isolate the first circuit from the second circuit, thereby maintaining a relatively high cooling water temperature in the first circuit.

By this arrangement, the top wall portions of the combustion chambers are maintained at a relatively low temperature thereby lowering the octane number requirement of the engine while the side wall portions of the cylinder bores are maintained at a relatively high temperature thereby substantially decreasing the emission of HC in exhaust gases.

Figure 2:
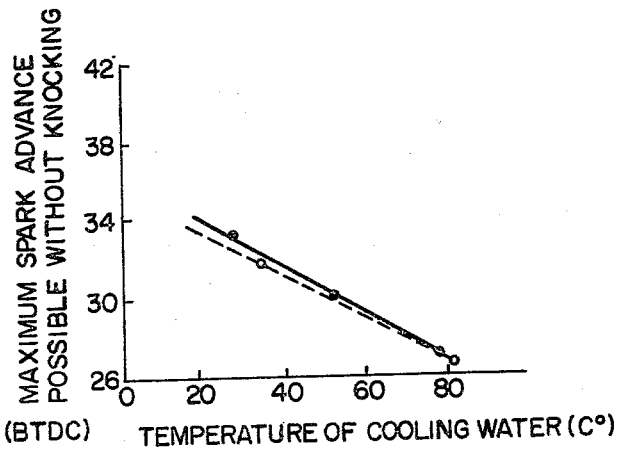
FIG. 2 is a graph showing the relation of the limit for not causing knocking expressed by spark advance to the temperature of cooling water.
Figure 3:
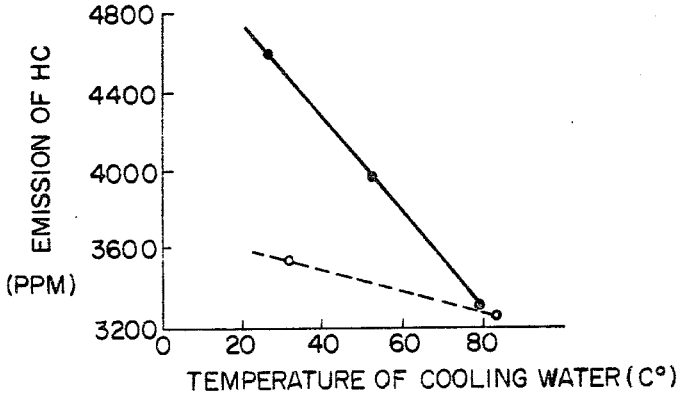
FIG. 3 is a graph showing the relation of the emission of HC in exhaust gases to the temperature of cooling water.

The behaviour of the octane number requirement of an internal combustion engine and of the emission of HC in exhaust gases are shown in FIGS. 2 and 3 in relation to the cooling water temperature of the engine. In FIG. 2 the ordinate represents the maximum spark advance possible without knocking, used as a parameter of octane number requirement, while the abscissa represents cooling water temperature. In FIG. 3, the ordinate represents the emission of HC in exhaust gases while the abscissa represents cooling water temperature. The results shown in FIGS. 2 and 3 have been obtained from an engine operating in the full load condition at the engine rotational speed of 2000 RPM under the supply of fuel-air mixture of air/fuel ratio of 13.5. In these figures, the solid lines show the results of employing a conventional cooling system which cools the cylinder head and the cylinder block to substantially the same temperature, whereas the broken lines show the results of employing a cooling system which cools only the cylinder head. As is apparent from these figures, the maximum spark advance possible without knocking is substantially the same for the two cases of cooling both the cylinder head and the cylinder block and of cooling only the cylinder head, and decreases in substantially the same manner in both cases as the cooling water temperature increases. By contrast, the emission of HC in exhaust gases substantially increases when both the cylinder head and the cylinder block are cooled when compared with the case of cooling only the cylinder block, although the emission gradually decreases as the cooling water temperature increases. From these results, it will be appreciated that in employing the conventional cooling system which applies substantially the same cooling effect to the cylinder head and to the cylinder block, if the cooling temperature is lowered for increasing the maximum spark advance possible without knocking, the emission of HC in exhaust gases substantially increases, while in employing the cooling system of the present invention, the maximum spark advance possible without knocking can be increased by lowering head cooling water temperature without causing any substantial increase of the emission of HC in exhaust gases.

In the cooling system of the present invention, only the cooling water contained in the first circuit incorporated in the cylinder block requires warming up in start-up operation, thereby reducing the amount of cooling water which requires warming up in start-up operation and, consequently, the time required for warming up an engine incorporating the cooling system of the present invention is shortened when compared with an engine incorporating a conventional cooling system. Furthermore, since the top wall portions of the combustion chambers are maintained at a relatively low temperature by the cooling system of the present invention, the maximum combustion temperature caused in the combustion chambers is correspondingly lowered, whereby the emission of NOx in exhaust gases is correspondingly reduced.

Figure 4:
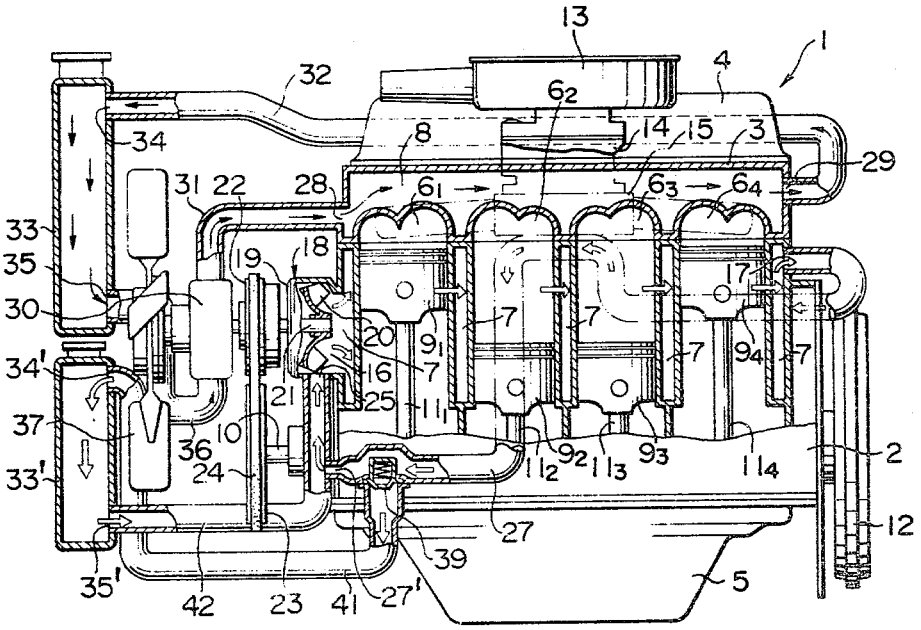
FIG. 4 is a partially sectional view of a multi-cylinder internal combustion engine incorporating another embodiment of the cooling system of the present invention.

FIG. 4 is a view similar to FIG. 1 showing another embodiment of the cooling system of the present invention incorporated in a similar internal combustion engine to that shown in FIG. 1. In FIG. 4, the portions corresponding to those shown in FIG. 1 are designated by the same reference numbers. In this embodiment, the first cooling water jacket 7 and the second cooling water jacket 8 are provided to be perfectly independent of each other and to be connected individually to separate radiators 33 and 33'. In this embodiment, therefore, no connecting pipes analogous to the connecting pipes 38 and 40 in the embodiment shown in FIG. 1 are provided. The second circuit has a structure similar to that shown in FIG. 1 and includes a circuit connection of water pump 30 - conduit 31 - cooling water jacket 8 - cooling water return pipe 32 - radiator 33 - conduit 36. In this case, however, the circuit is completely isolated. On the other hand, the first circuit comprises a main circuit including water pump 18 - cooling water jacket 7 - cooling water return pipe 27 and a branch circuit branched from a middle portion of the cooling water return pipe 27 through a thermostat valve 39' and rejoined to the cooling water return pipe 27 at a downstream portion of the thermostat valve 39', said branch circuit including a radiator 33', a conduit 41 connecting the outlet port of the thermostat valve 39' to an inlet port 34' of the radiator 33' and another conduit 42 connecting an outlet port 35' of the radiator 33' to the cooling water return pipe 27 at a downstream portion of the thermostat valve 39'. A throttling portion 27' is provided at a middle portion of the cooling water return pipe 27 at a position located between the thermostat valve 39' and the rejoining portion of the conduit 42.

In operation of this embodiment, the second circuit including the cooling water jacket 8 for cooling the top wall portion of the combustion chambers always circulates cooling water to the radiator 33 thereby always maintaining that cooling water at a relatively low temperature, while the first circuit allows only a part of the cooling water circulating therethrough to flow through the radiator 33' by being branched through the thermostat valve 39' only when the cooling water temperature rises beyond a predetermined temperature thereby always maintaining the cooling water circulating around the side wall portions of the cylinder bores at a relatively high temperature.

Although the invention has been shown and described with respect to some preferred embodiments thereof, it should be understood by those skilled in the art that various changes and omissions of the form and detail thereof may be made therein without departing from the scope of the invention.

We claim:

1. A cooling system for an internal combustion engine which has a cylinder block and a cylinder head, comprising a first circuit means which circulates cooling water through said cylinder block, and a second circuit means which circulates cooling water through said cylinder head, wherein:

the first circuit means comprises a first water pump and a passage portion formed in said cylinder block, and the second circuit means comprises a second water pump, a radiator, and a passage portion formed in said cylinder head, further comprising: a first connecting passage means which connects a portion of said second circuit means located downstream of said radiator to a portion of said first circuit means located upstream of said first water pump, a second connecting passage means which connects a portion of said first circuit means located at the exit of said passage portion formed in said cylinder block to a portion of said second circuit means located at the exit of said cylinder head, and a thermostat valve incorporated in said first connecting passage means which responds to the water temperature in said first circuit.

2. The cooling system of claim 1, wherein said first circuit means includes a cooling water return pipe which connects the exit portion of said circuit means formed in said cylinder block to an inlet portion of said first water pump, said cooling water pipe having a middle portion which is heat-conductively connected with a riser portion of an intake manifold incorporated in the engine.

* * * * *